US011338969B2

(12) United States Patent
Steele

(10) Patent No.: US 11,338,969 B2
(45) Date of Patent: May 24, 2022

(54) PACKAGE HAVING A CHILD-RESTRICTIVE OPENING FEATURE

(71) Applicant: Mark Steele, New Prague, MN (US)

(72) Inventor: Mark Steele, New Prague, MN (US)

( * ) Notice: Subject to any disclaimer, the term of this patent is extended or adjusted under 35 U.S.C. 154(b) by 0 days.

(21) Appl. No.: 15/512,555

(22) PCT Filed: Sep. 18, 2015

(86) PCT No.: PCT/US2015/051096

§ 371 (c)(1),
(2) Date: Mar. 18, 2017

(87) PCT Pub. No.: WO2016/044812

PCT Pub. Date: Mar. 24, 2016

(65) Prior Publication Data

US 2017/0217650 A1 Aug. 3, 2017

Related U.S. Application Data

(60) Provisional application No. 62/052,418, filed on Sep. 18, 2014, provisional application No. 62/072,987,
(Continued)

(51) Int. Cl.
*B65D 50/00* (2006.01)
*B65D 33/25* (2006.01)

(52) U.S. Cl.
CPC ..... *B65D 50/00* (2013.01); *B65D 33/2508* (2013.01); *B65D 33/2541* (2013.01);
(Continued)

(58) Field of Classification Search
CPC ..... B65D 50/00; B65D 33/2591; B65D 33/2508; B65D 33/2525; B65D 33/2533; B65D 2215/08
(Continued)

(56) References Cited

U.S. PATENT DOCUMENTS 2,952,395 A 9/1960 Spees
3,102,570 A * 9/1963 Fairchilds ..... A44B 19/32 2/96
(Continued)

FOREIGN PATENT DOCUMENTS

CA 2845896 A1 9/2014
EP 2202173 A1 6/2010
(Continued)

OTHER PUBLICATIONS

The extended European Search Report rendered by the European Patent Office for European Patent Application No. 15842349.1(regional phase of PCT application No. PCT/US2015/051096), dated Apr. 23, 2018, 7 pages.
(Continued)

*Primary Examiner* — Jes F Pascua
(74) *Attorney, Agent, or Firm* — Skaar Ulbrich Macari, P.A.

(57) ABSTRACT

A package is provided to make it more resistant to access by individuals, such as small children, while remaining simple enough for an adult to open. A feature, such as a top gusset or a breachable flange or flap, can be provided to promote the child resistance attributes of the package.

19 Claims, 16 Drawing Sheets

Related U.S. Application Data filed on Oct. 30, 2014, provisional application No. 62/082,694, filed on Nov. 21, 2014, provisional application No. 62/086,372, filed on Dec. 2, 2014, provisional application No. 62/094,012, filed on Dec. 18, 2014, provisional application No. 62/156,369, filed on May 4, 2015.

(52) U.S. Cl.
CPC ..... *B65D 33/2566* (2013.01); *B65D 33/2575* (2013.01); *B65D 33/2525* (2013.01); *B65D 33/2533* (2013.01); *B65D 2215/04* (2013.01); *B65D 2215/08* (2013.01)

(58) Field of Classification Search
USPC ..... 383/63–65, 61.1, 61.2, 59, 61.3; 24/384
See application file for complete search history.

(56) References Cited

U.S. PATENT DOCUMENTS 3,419,137 A 12/1968 Walck, III
3,469,768 A 9/1969 Repko
3,998,304 A * 12/1976 Edgerton, Jr. ..... A45C 3/00 190/107
4,519,499 A 5/1985 Stone et al.
4,877,334 A 10/1989 Cope
4,877,336 A * 10/1989 Peppiatt ..... B65D 33/10 383/109
4,892,414 A * 1/1990 Ausnit ..... B65D 33/2516 383/5
4,909,017 A 3/1990 McMahon et al.
4,925,316 A * 5/1990 Van Erden ..... B65D 33/20 383/210
4,993,844 A 2/1991 Robinson et al.
5,003,634 A * 4/1991 Brinkman ..... A41D 13/0537 2/253
5,024,537 A * 6/1991 Tilman ..... A44B 19/34 206/820
5,118,202 A 6/1992 Bruno
5,221,143 A * 6/1993 Peppiatt ..... B65D 31/04 383/29
5,461,845 A 10/1995 Yeager
5,492,219 A 2/1996 Stupar
5,672,009 A 9/1997 Malin
5,782,733 A 7/1998 Yeager
5,806,984 A 9/1998 Yeager
5,826,401 A 10/1998 Bois
5,829,884 A 11/1998 Yeager
5,902,047 A 5/1999 Yeager
5,924,172 A * 7/1999 Klein ..... A44B 19/32 2/96
5,951,453 A 9/1999 Yeager
5,954,433 A 9/1999 Yeager
5,972,396 A 10/1999 Jurgovan et al.
6,053,635 A 4/2000 Anderson et al.
6,079,878 A 6/2000 Yeager
6,115,892 A 9/2000 Malin et al.
6,126,317 A 10/2000 Anderson et al.
6,177,172 B1 1/2001 Yeager
6,224,262 B1 * 5/2001 Hogan ..... B65D 33/2533 383/201
6,245,367 B1 6/2001 Galomb
6,264,366 B1 * 7/2001 Custer ..... B65D 33/2591 24/400
6,327,837 B1 12/2001 Van Erden
6,354,738 B1 3/2002 Buckman et al.
6,481,891 B2 11/2002 Yeager
6,616,333 B2 9/2003 Kinigakis et al.
6,659,643 B2 * 12/2003 Plourde ..... B65D 33/2525 383/203
6,820,391 B2 11/2004 Barmore et al.
6,886,980 B1 5/2005 Diplock
6,960,021 B2 * 11/2005 Schneider ..... B65D 33/2591 383/203
7,101,079 B2 9/2006 Strand et al.
7,207,717 B2 4/2007 Steele
7,553,083 B2 6/2009 Plourde
7,597,480 B2 10/2009 Kuge et al.
7,673,437 B2 * 3/2010 Schneider ..... B65D 33/2591 53/139.2
8,540,427 B2 * 9/2013 Steele ..... B65D 33/2575 383/120
9,365,326 B2 6/2016 Bois
10,029,826 B2 * 7/2018 Petkovsek ..... B65D 33/2508
2001/0053253 A1 * 12/2001 Buchman ..... B65D 33/2591 383/5
2002/0097923 A1 * 7/2002 Dobreski, V ..... B65D 33/2508 383/5
2003/0002753 A1 * 1/2003 Stolmeier ..... B32B 7/08 383/64
2003/0103687 A1 6/2003 Schneider et al.
2004/0031244 A1 2/2004 Steele
2005/0220371 A1 10/2005 Machacek
2006/0072854 A1 * 4/2006 Schreiter ..... B65D 33/2591 383/5
2006/0104550 A1 5/2006 Kuge et al.
2006/0210202 A1 * 9/2006 Plourde ..... B65B 9/20 383/63
2006/0257533 A1 * 11/2006 Plourde ..... B65D 33/2508 426/106
2007/0206888 A1 9/2007 Chang
2008/0002918 A1 1/2008 Steele
2008/0240625 A1 10/2008 McCracken et al.
2009/0067761 A1 * 3/2009 Koenigkramer ... B65D 33/2508 383/210.1
2009/0208147 A1 8/2009 Steele
2009/0238499 A1 9/2009 Steele
2009/0245699 A1 10/2009 Steele
2010/0002964 A1 1/2010 Yeager et al.
2010/0226600 A1 9/2010 Steele
2011/0103714 A1 5/2011 Steele et al.
2011/0182531 A1 7/2011 Steele
2012/0074002 A1 3/2012 Steele et al.
2012/0196730 A1 8/2012 Steele et al.
2012/0314978 A1 12/2012 Tamaoki et al.
2013/0195385 A1 8/2013 Matias
2014/0044379 A1 2/2014 Gum
2014/0161374 A1 6/2014 Septien Rojas et al.
2016/0046409 A1 2/2016 Steele

FOREIGN PATENT DOCUMENTS

EP 2284091 B1 * 12/2012 ..... B65D 33/2508
JP 2006081743 A * 3/2006
WO 2004002852 A1 1/2004
WO WO 2016/058204 A1 * 4/2016

OTHER PUBLICATIONS

International Preliminary Report on Patentability rendered by the International Bureau of WIPO for PCT/US2015/051096, dated Mar. 21, 2017, 6 pages.
The International Search Report and Written Opinion rendered by the International Searching Authority for PCT/US15/51096, dated Jan. 5, 2016, 24 pages.

* cited by examiner

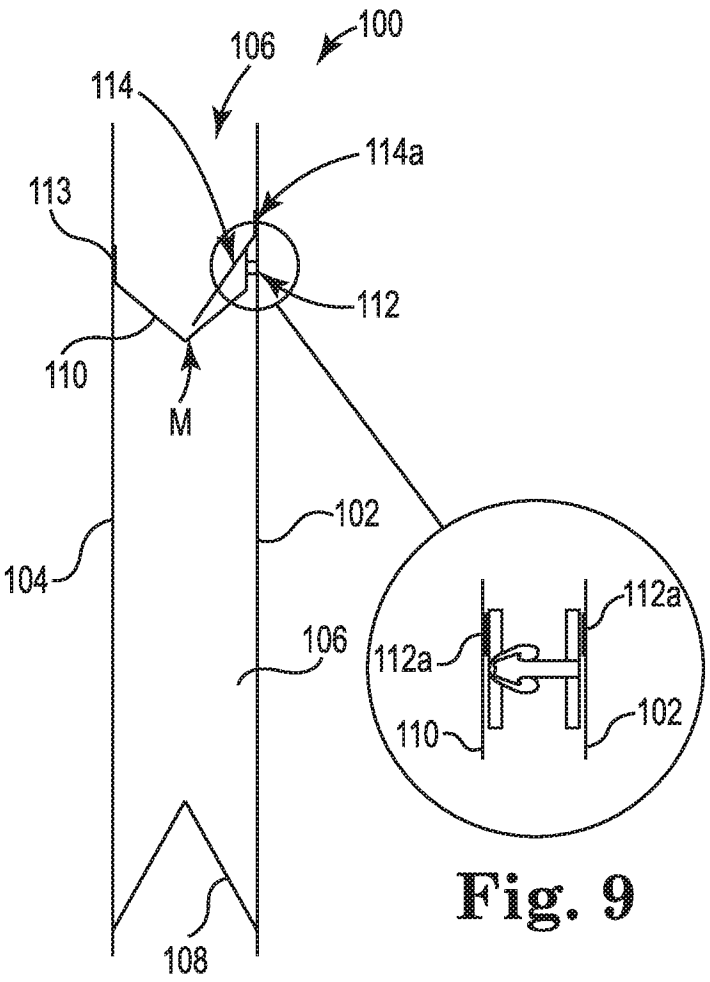
Fig. 8
Fig. 9
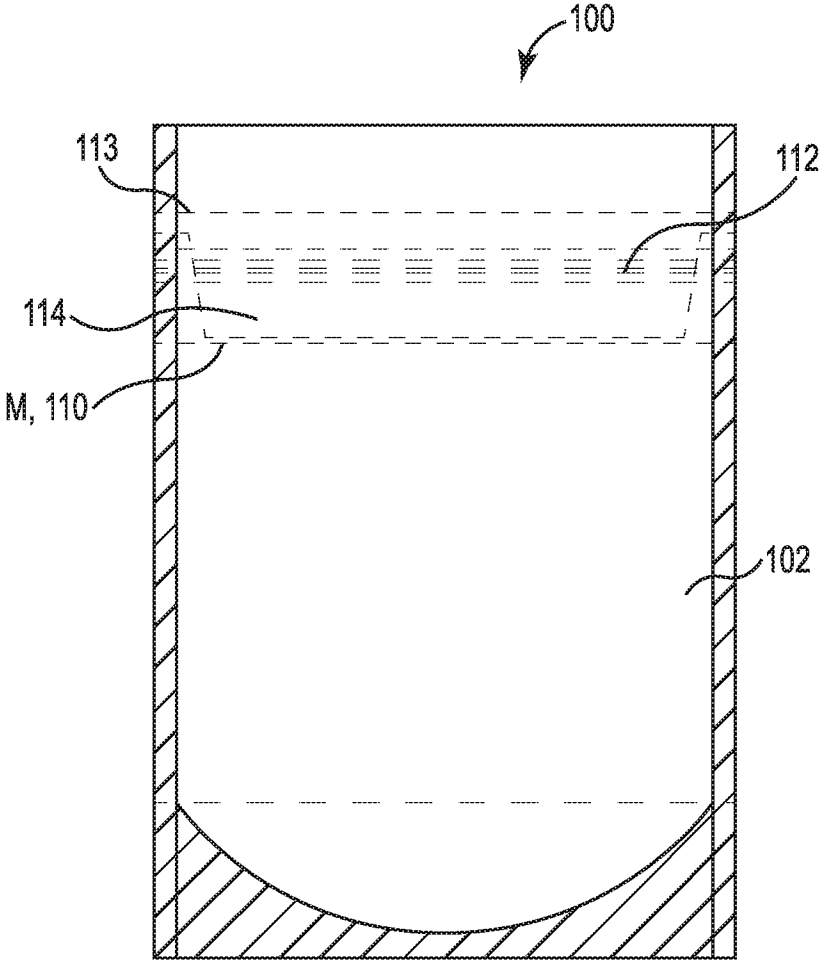
Fig. 7

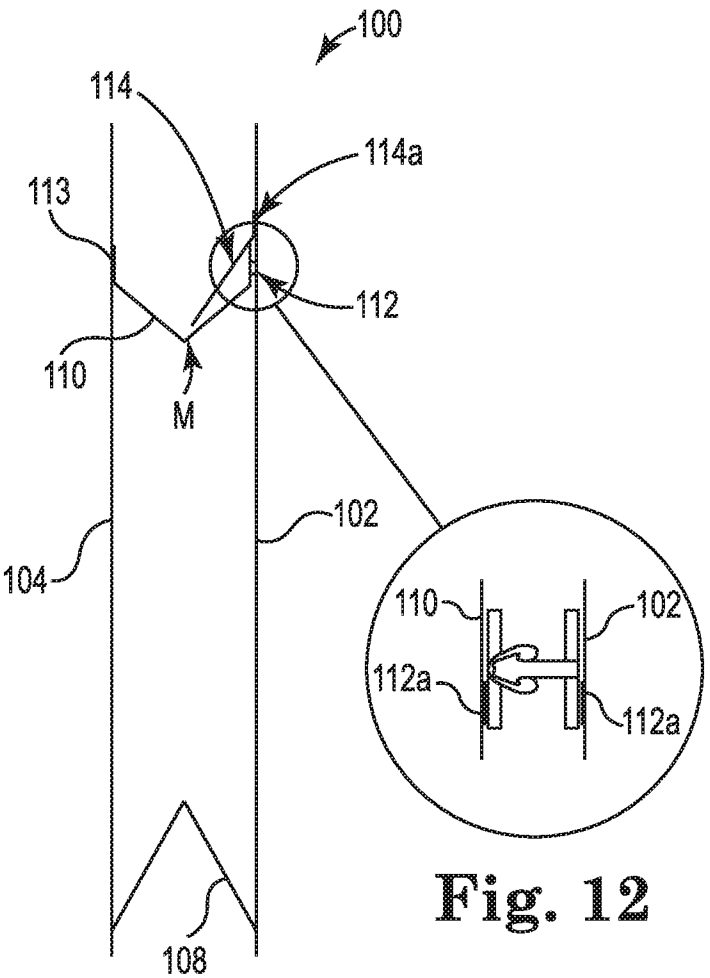
Fig. 11
Fig. 12
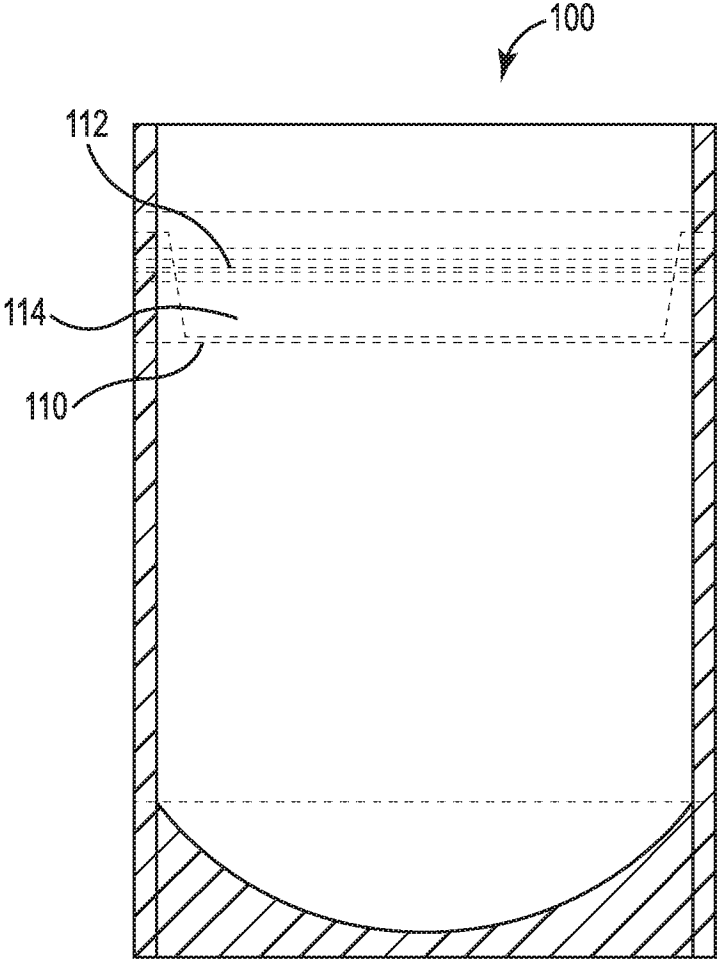
Fig. 10

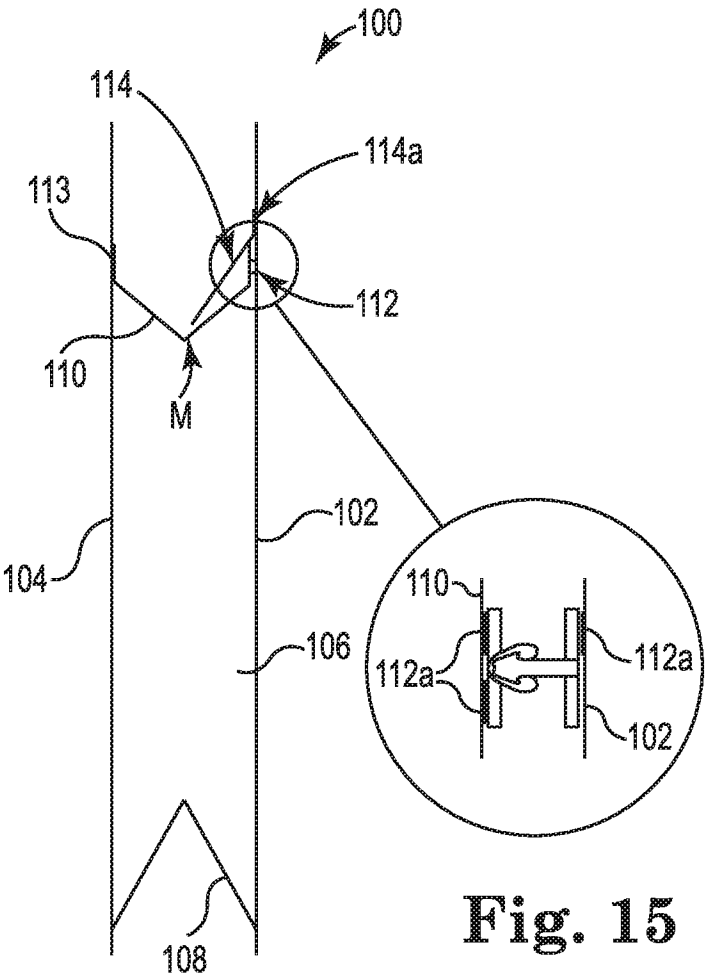
Fig. 15
Fig. 14
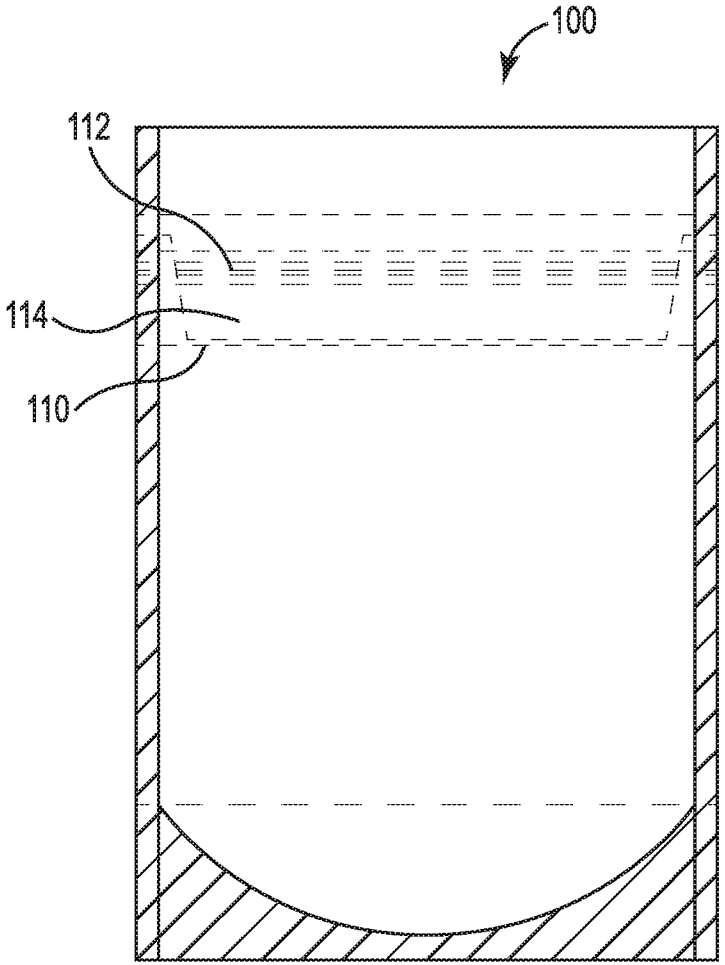
Fig. 13

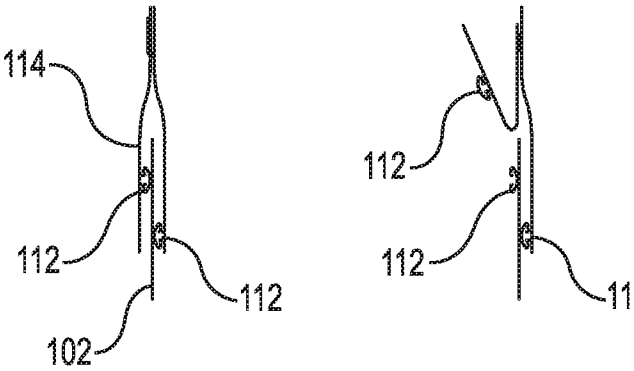
Fig. 32
Fig. 33
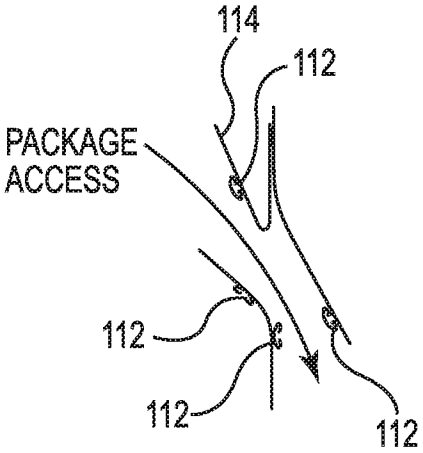
Fig. 34
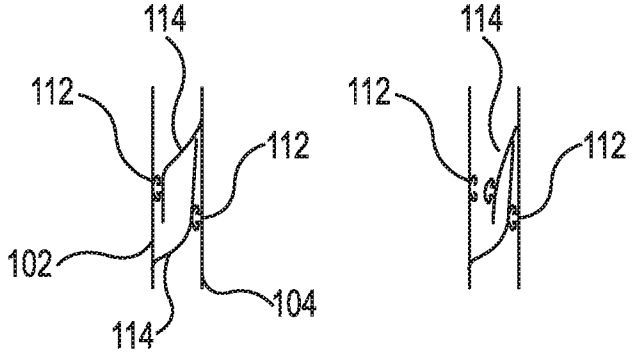
Fig. 35
Fig. 36
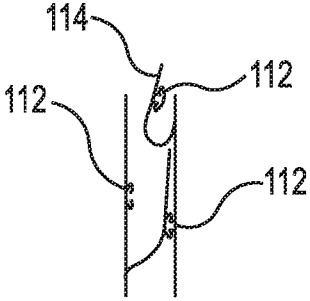
Fig. 37
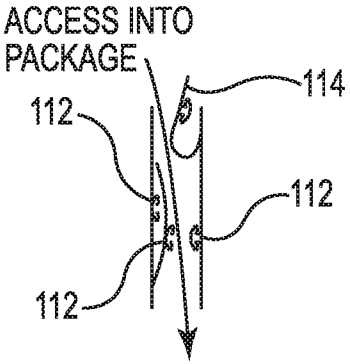
Fig. 38

PACKAGE HAVING A CHILD-RESTRICTIVE OPENING FEATURE

PRIORITY

This Application claims priority to and the benefit of U.S. Provisional Patent Application No. 62/052,418, filed Sep. 18, 2014, U.S. Provisional Patent Application No. 62/072,987, filed Oct. 30, 2014, U.S. Provisional Patent Application No. 62/082,694, filed Nov. 21, 2014, U.S. Provisional Patent Application No. 62/086,372, filed Dec. 2, 2014, U.S. Provisional Patent Application No. 62/094,012, filed Dec. 18, 2014, and U.S. Provisional Patent Application No. 62/156,369, filed May 4, 2015; each of the above-referenced applications and disclosures incorporated fully herein by reference.

FIELD OF THE INVENTION

The present invention relates generally to flexible packaging and, more particularly, to packages, and methods for forming and using packages, having a child-restrictive opening feature.

BACKGROUND OF THE INVENTION

Flexible packages are used for containing a wide variety of items, both solid and liquid, such as beverages, lawn products and food products. More and more packages, including flexible packages, are being used for the containment and or dispensing of food, cleaning liquids or medical products.

More and more focus is being directed to providing products designed to be easier for the adults in the household to use, but may contain items or materials that are dangerous for young children to come into contact with. One example of this is the small multi-colored packets of dish washer detergent or washing machine soap. The consumer simply opens the pouch the product came in and pulls a packet out to place in the washing machine or dish washer, depending on which product they are using.

Undesirably, some children may see the colored packets and think they are edible. Even young children can open today's current pouches with or without a zipper closure on them. While over the years things like prescription bottles have been designed to make it difficult for children to open them and access the contents, this has created other problems. The caps or tops designed to solve this problem do work well at keeping children out of them, but they also make it virtually impossible for older adults, or people with arthritis or other debilitating issues, to open them and get the needed product.

As such, there is a need for an effective yet easy to use solution to providing packages that incorporate safe and restrictive opening features.

SUMMARY OF THE INVENTION

The present invention addresses certain problems facing flexible packages and the packaging industry. Embodiments of the present invention are directed to a flexible package designed to make it more resistant to access by small children, while remaining simple enough for an adult to open, even those with some loss of manual mobility and agility in their hands.

The package or pouch of the present invention can include a top gusset on the pouch which is only sealed to one panel of the pouch, e.g., the front or back panel. The opposing side of the top gusset is either not attached to the opposing panel of the pouch at all, except in the side seals, or preferably is attached along its top edge by a recloseable device—such as a zipper. This will be the portion in which the consumer will ultimately access the product when needed or desired. Additionally, a safety flap of material is sealed to the opening panel of the pouch, inside the pouch, just above the opening side of the gusset, and hinges down over the top gusset, approximately to its midway point where the gusset is folded.

The flap can cover the opening so it is not readily noticeable to the untrained eye. After the initial top seal is torn off or otherwise removed to access the contents, the consumer will grab the front and back panels of the package and attempt to pull them apart to access the contents. However, because there is a gusset panel of film that spans between the front and back panel, direct access to the contents is hindered at this point. It is only when the person is directed to the flap of extra film material and pulls it back toward the top of the pouch, e.g., all the way to the hinged seal, that they will expose the true opening into the pouch—between the covered half of the top gusseted panel and that same side of the pouch. To make this even less obvious, the end of the flap that is opposite the hinged seal can include a pressure sensitive material along its edge so that it adheres to the gusset and blends in to not be noticed as easily. Depending on how close the pressure sensitive material is located to the edge, it will either be more difficult or more easily peeled away to expose the opening underneath.

Once the true opening is exposed, the consumer can grasp the lip of the top gusset film that is just under the hinged flap, as well as that same panel of the pouch, and pull them apart to provide clear access to the contents.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

FIG. 7 shows a front view of a package having a top gusset feature, a child restrictive safety flap, and an access device, in accordance with embodiments of the present invention.

FIG. 8 is a side schematic cross-section view of the package of FIG. 7.

FIG. 9 is an isolated close-up view of the access device portion of FIG. 8 with select zipper flanges unsealed.

FIG. 10 shows a front view of a package having a top gusset feature, a child restrictive safety flap, and an access device, in accordance with embodiments of the present invention.

FIG. 11 is a side schematic cross-section view of the package of FIG. 10.

FIG. 12 is an isolated close-up view of the access device portion of FIG. 11 with select zipper flanges unsealed.

FIG. 13 shows a front view of a package having a top gusset feature, a child restrictive safety flap, and an access device, in accordance with embodiments of the present invention.

FIG. 14 is a side schematic cross-section view of the package of FIG. 13.

FIG. 15 is an isolated close-up view of the access device portion of FIG. 14 with select zipper flanges unsealed.

FIGS. 32-34 show side schematic cross-section views of a front panel closure device having a safety flap as part of the closure device shown with alternative additional locking member, in accordance with embodiments of the present invention.

FIGS. 35-38 show side schematic cross-section views of a top-opening closure device having an internal safety flap as part of the closure device shown with an alternative additional locking member, in accordance with embodiments of the present invention.

Figure 2:
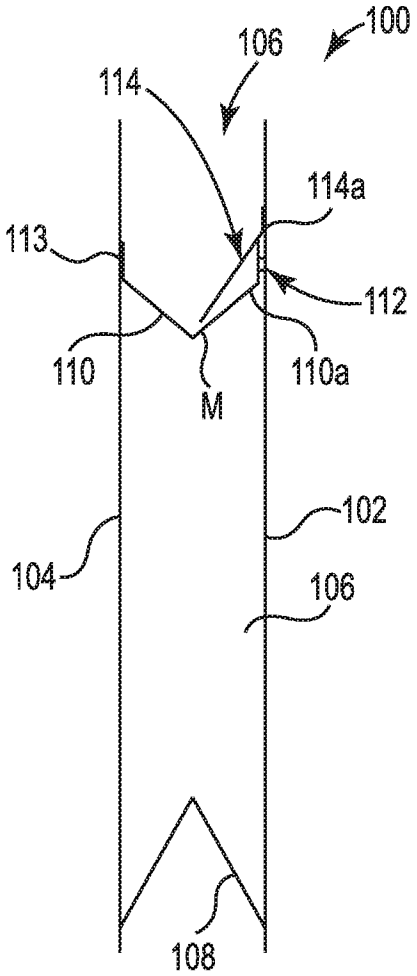
FIG. 2 is a side schematic cross-section view of the package of FIG. 1.
Figure 1:
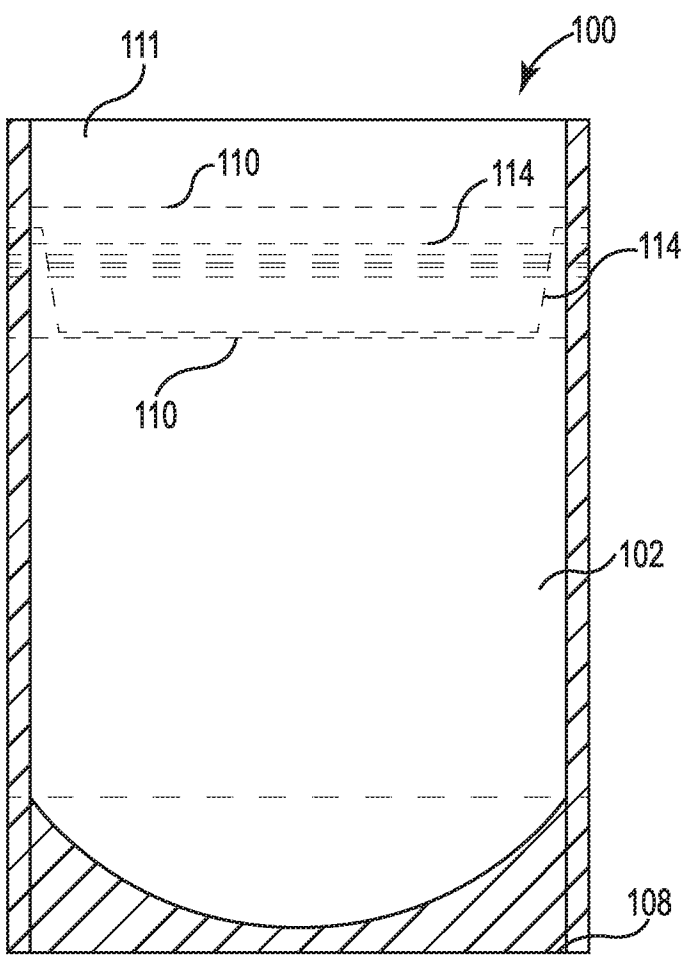
FIG. 1 shows a front view of a package having a top gusset child-restrictive opening feature, in accordance with embodiments of the present invention.
Figure 5:
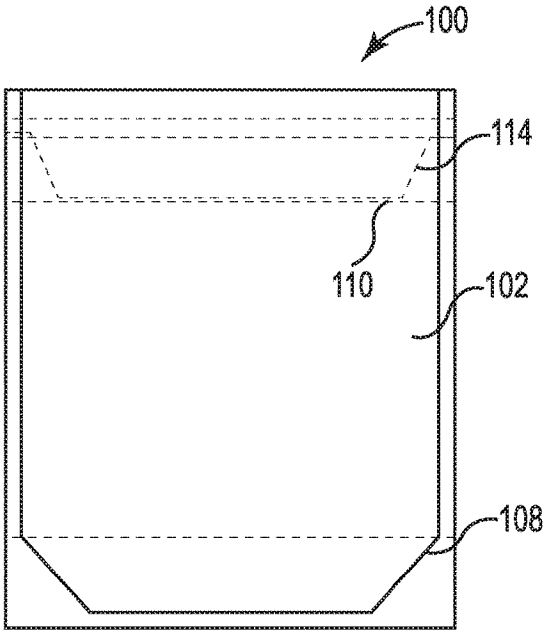
FIG. 5 shows a package having a top gusset feature and a child restrictive safety flap, in accordance with embodiments of the present invention.
Figure 4:
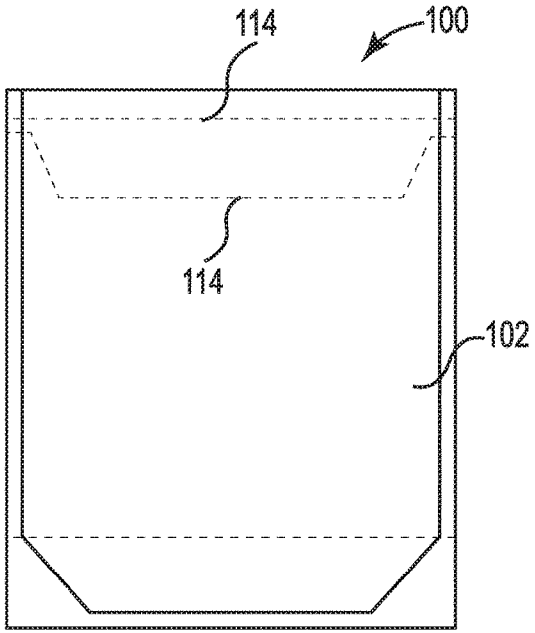
FIG. 4 shows a package having a child-restrictive safety flap, in accordance with embodiments of the present invention.
Figure 3:
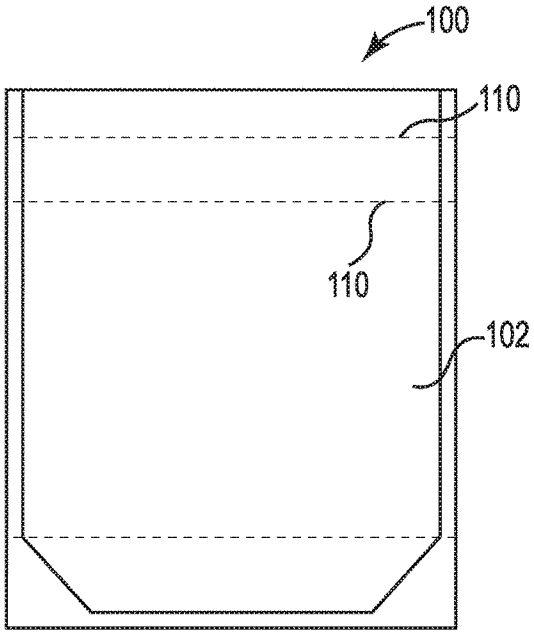
FIG. 3 shows a package having a top gusset feature, in accordance with embodiments of the present invention.
Figure 6:
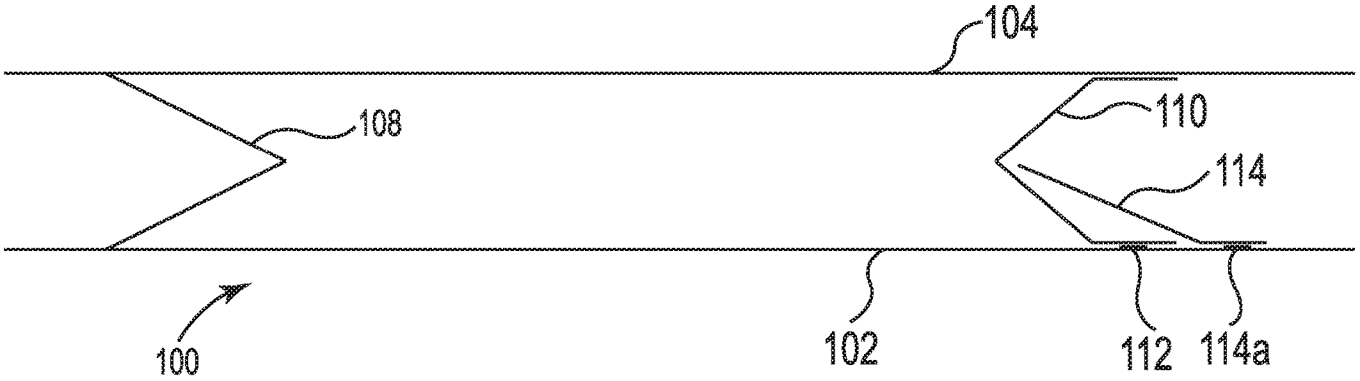
FIG. 6 is a side schematic cross-section view of a package having a top gusset feature and a child restrictive safety flap, in accordance with embodiments of the present invention.
Figure 17:
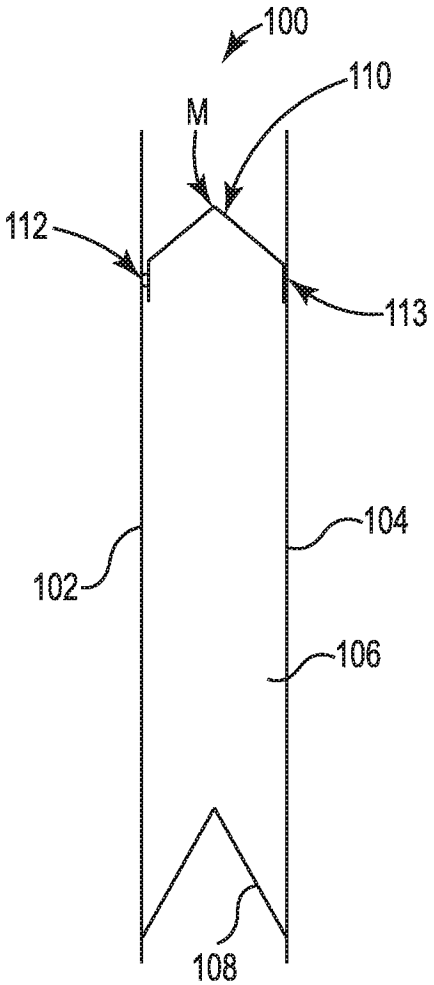
FIG. 17 is a side schematic cross-section view of the package of FIG. 16.
Figure 16:
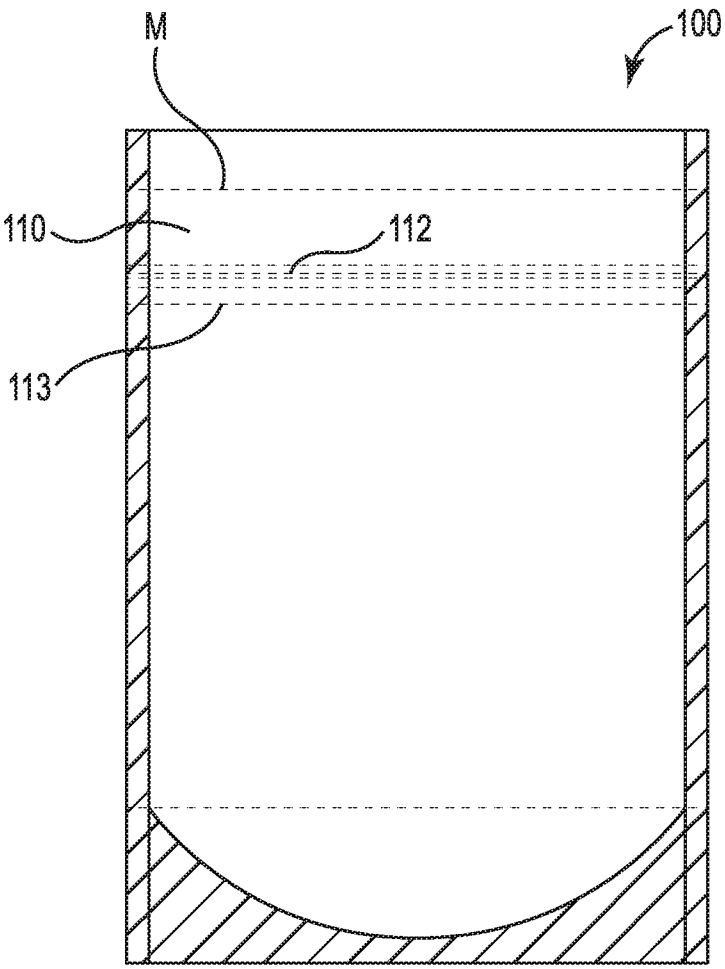
FIG. 16 shows a front view of a package having an inverted top gusset feature, in accordance with embodiments of the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims. For illustrative purposes, cross-hatching, dashing or shading in the figures can be provided to demonstrate sealed portions and/or integrated regions or devices for the package, or to show seals or other structures behind a package film or portion.

DETAILED DESCRIPTION OF THE INVENTION

In the following descriptions, the present invention will be explained with reference to example embodiments thereof. However, these embodiments are not intended to limit the present invention to any specific example, embodiment, environment, applications or particular implementations described in these embodiments. Therefore, description of these embodiments is only for purpose of illustration rather than to limit the present invention. It should be appreciated that, in the following embodiments and the attached drawings, elements unrelated to the present invention are omitted from depiction; and dimensional relationships among individual elements in the attached drawings are illustrated only for ease of understanding, but not to limit the actual scale.

References to "top," "bottom," "front," "side," "back" and the like are for illustrative purposes only and are not meant to limit the scope of the disclosed invention.

Referring generally to 1-49, the flexible package 100 of the present invention can comprise a front panel portion 102 and back panel portion 104 defining an interior compartment 106 accessible through an access opening. The front and back panel portions 102, 104 can be formed from the shaping and sealing of a single web member of material, or from multiple webs. One or more of the portions of the package 100 may be gusseted. Placing a gusset on the bottom panel 108 also provides the product with the ability to stand up on its own. Other panels, such as a side panel, could be gusseted as well.

Various zipper, package and/or closure features, constructs, structures and forming methods are provided with embodiments of the package 100 of the present invention.

Referring to FIGS. 1-6, embodiments of the present invention are shown that provide a package 100 designed to make it more difficult for small children to access, and yet remain simple enough for an adult to open—even those with a loss of mobility or dexterity in their hands.

The package or pouch 100 can include a top gusset 110 on the pouch which is only sealed to one panel of the package, e.g., either the front panel 102 or back panel 104. The opposing side of the top gusset 110*a* is either not attached to the opposing panel of the pouch at all, except in the side seals, or preferably is attached along its top edge by a recloseable device, such as a zipper 112. The portion with the zipper or other recloseable device will be the portion in which the consumer will ultimately access the product when they wish. Additionally, a safety flap of material 114 can be sealed to the inside of the opening panel (e.g., front panel 102) of the package, just above the opening side 110*a* of the gusset 110, and can hinge or lay down over the top gusset 110, approximately to its midway point M where the gusset 110 is folded.

This flap 114 covers the opening so it is not readily noticeable to the untrained eye. After the initial top seal 111 is torn off to access the contents, the consumer will grab the front and back panels 102, 104 of the package 100 just like they would any other pouch or package and try to pull them apart to access the contents. However, because there is a gusset of film 110 that spans between the front and back panels, direct access to the contents is hindered. It is only when the person notices, or is directed to, the flap of extra film material 114 and pulls or hinges it back toward the top of the pouch, all the way to the hinged seal 114*a*, that they will expose the true opening into the package, which is between the covered half of the top gusseted panel (from fold M to end 110*a*) and that same side of the package. To make this even less obvious, the free end of the flap 114 that is generally opposite the hinged seal 114*a* can include a pressure sensitive or like material along its edge so it adheres to the gusset 110 and blends in to not be easily noticeable. Depending on how close the pressure sensitive material is located to the edge, it will either be more difficult or more easily peeled away from the gusset 110 to expose the opening underneath.

The hinged safety flap 114 can also be made to such a length, from the hinged/sealed edge 114*a* to the opposing edge or free end, in correlation with the distance the device 112 is placed down into the package, that it will hinder the user's ability to close the package without first hinging the safety flap 114 back into the original position. This is especially true with a rigid or semi rigid material being used for the safety flap 114. The distance between the non-hinged edge or free end of the safety flap 114 when it is hinged outward, and the closure feature 112, are far enough apart that the web of the user's hand between their forefinger and their thumb will not allow them to reach the reclose device 112. This can be done to help ensure users don't leave the safety flap hinged outward when they close the package 100, thus exposing the way to open the pouch to a child.

The top of the package 100, and/or the safety flap 114 itself, can also be construed or formed in variety of shapes and sizes to promote the hinging of the flap 114 back into the package before closing. In addition, one or more of the flanges (e.g., portions sealed to the inside of the package panel) of the device 112 can be made extra long, or longer than the others, and act as the safety flap 114 itself.

Once the true opening is exposed, the consumer can grab the lip or other portion of the top gusset film 110 that is just under the hinged flap 114, as well as that same panel of the pouch (e.g., front 102), and pull them apart to provide clear access to the internal contents of the package 100—e.g., breach or otherwise pull away from a seal (e.g., 113 or from 112) attaching it to a package panel, closure device, etc.

Further, the hinged safety flap 114 can be made of various materials, including a rigid or semi rigid material. It can be made in different sizes, colors, and shapes, with an eye toward hiding or disguising the main access point to the structure and package contents.

In addition, all or a portion of the safety flap 114 can be made or provided such that it is narrower (e.g., via tapering) than the inside width of the package (e.g., the width of the panels 102, 104) to facilitate pulling it back out of the way. The consumer can either tuck the flap 114 inside the opening, once the zipper 112 has been opened, or leave it out to be used as a pour spout.

In certain embodiments, the package 100 does not require a recloseable device and works without one—while still hiding the access point under the safety flap 114. However, the recloseable device may be preferred in certain embodiments for additional safety.

The entire top section of the package 100, including the top gusset 110, safety flap 114, and recloseable device 112, as well as some portion of the front and back panels 102, 104, can also be made as a separate assembly and later added to a pouch, box, or existing web of material to make the entire package easier to manufacture or form.

As depicted in FIGS. 7-15, one or more of the re-closeable device's (e.g., zipper) 112 flanges can be left unsealed to a surface of the respective top gusset 110 and package panel, such as panel 102. FIGS. 8-9 show an embodiment where the top flanges of the device 112 are sealed at seals 112*a*, while the bottom flanges of the device 112 are not sealed to the package panel 102 or the top gusset 110. Similarly, FIGS. 11-12 show an embodiment with the device 112 bottom flanges sealed at 112*a* to the respective package surfaces, and the top flanges remain unsealed. FIGS. 14-15 demonstrate a device 112 where all but one of the flanges (e.g., one bottom flange) are sealed to the respective package surfaces at 112*a*. When the consumer opens the package with these various embodiments, without lifting the flap, the device 112 will hinge due to the unsealed flange portion, thereby making it more difficult to force open—rendering the package increasingly more child restrictive. While certain flanges have been shown sealed and unsealed to the package, other variations in the sealing/unsealing configuration can be employed without deviating from the spirit and scope of the present invention. For example, at least one of the flanges of the device 110 can be left unsealed to the desired hinging to promote a child restrictive package.

Figure 19:
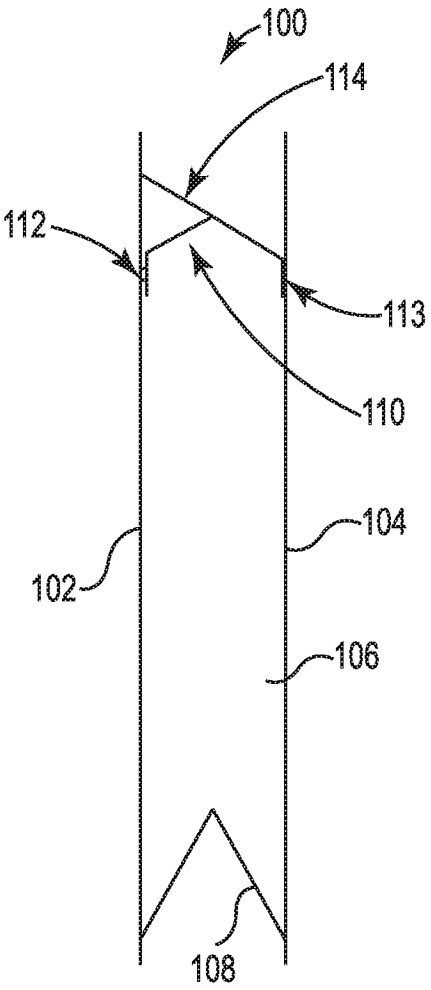
FIG. 19 is a side schematic cross-section view of the package of FIG. 18.
Figure 18:
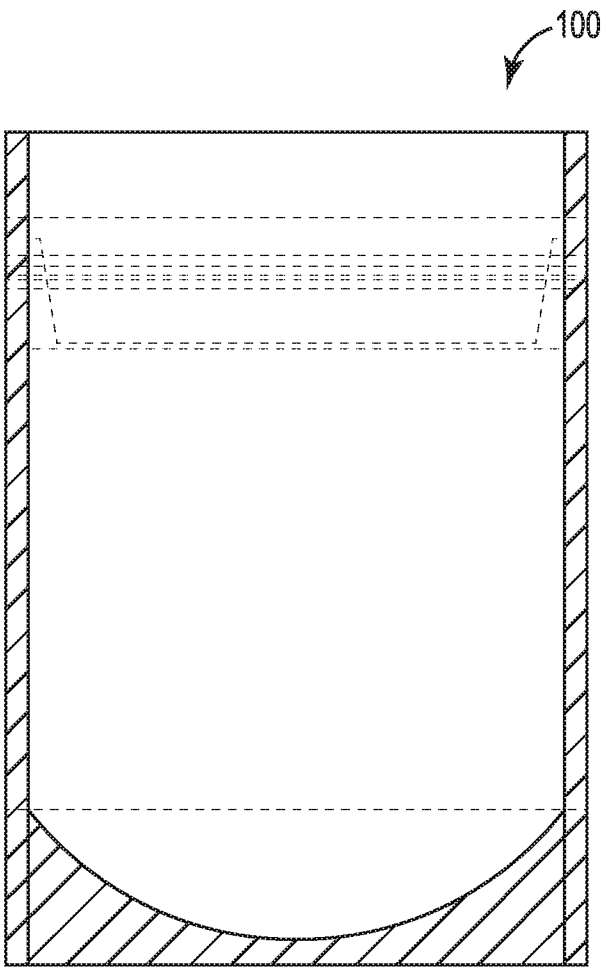
FIG. 18 shows a front view of a package having an inverted top gusset feature and a safety flap, in accordance with embodiments of the present invention.

FIGS. 16-19 depict an embodiment of the package 100 having an inverted top gusset panel or portion 110. Again, the panel 110 can be bent, formed or otherwise define a bend at M. Like the other embodiments of the top gusset 110, this variation can also promote a child restrictive package. FIG. 19 shows the safety flap 114 extending over and past the top gusset 110 for sealing to the inside of one of the panels—e.g., panel 102—as disclosed herein. The flap 114 can be adhered to a portion of the gusset 110 or separately attached within the package and merely proximate or laying against the gusset 110.

Figures 20, 21, 22, 23:
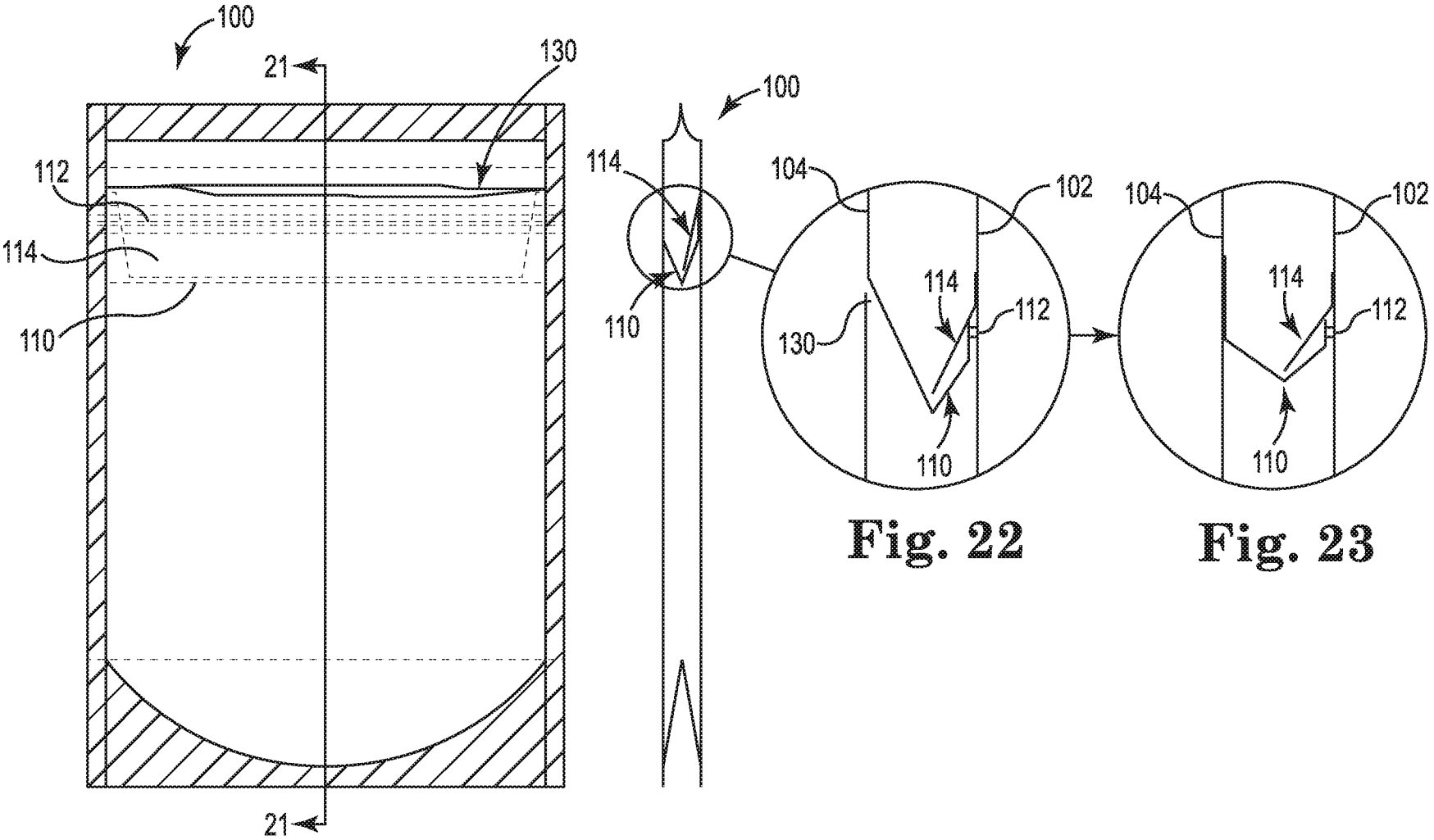
FIG. 20 shows a front view of a package having top gusset feature, a safety flap, and a fill slit opening, in accordance with embodiments of the present invention.
FIG. 21 is a side schematic cross-section view of the package of FIG. 20.
FIG. 22 is an isolated close-up view of the package of FIG. 21 with the slit opening opened.
FIG. 23 is an isolate close-up view of the package of FIG. 22 with the slit opening sealed closed.
Figure 24:
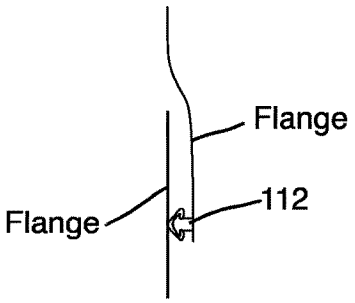
FIG. 24 shows a side schematic cross-section of a front panel zipper device and attachment technique.
Figure 25:
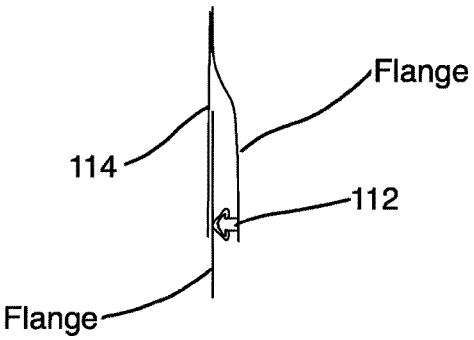
FIGS. 25-29 show a safety flap provided with a portion of a front panel opening zipper device, in accordance with embodiments of the present invention.
Figure 26:
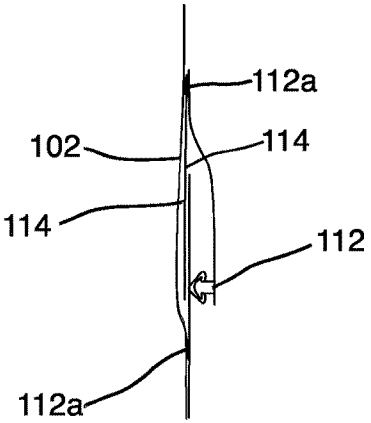
Figure 27:
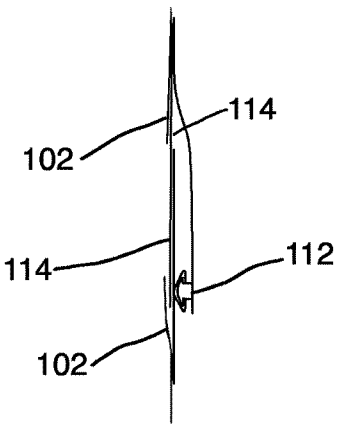
Figure 28:
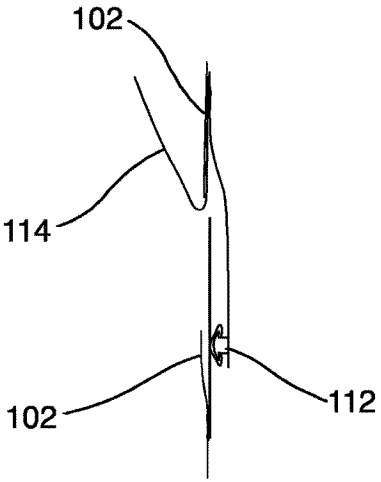
Figure 29:
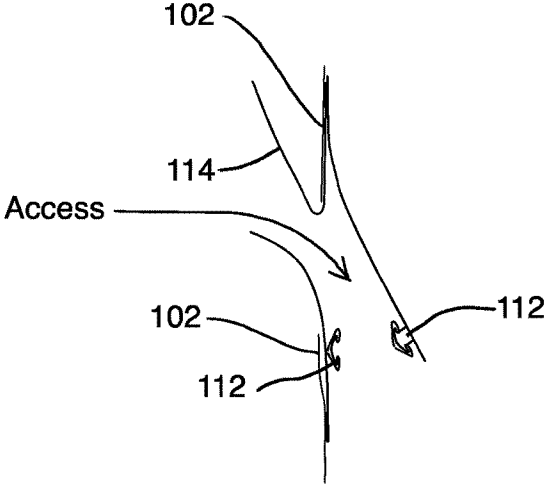
Figure 30:
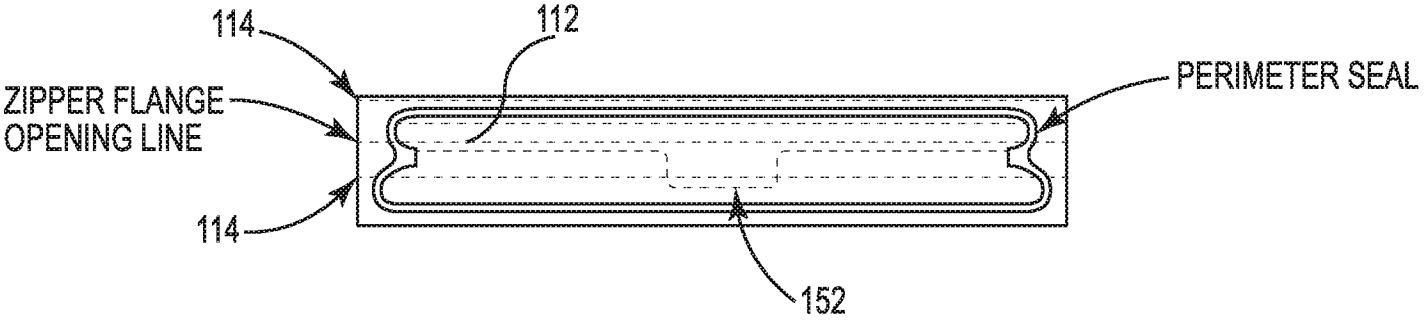
FIG. 30 shows a safety flap and zipper device having a tamper evident perforated film, in accordance with embodiments of the present invention.

FIGS. 20-23 show an embodiment of the package 100 having a fill slit feature 130. The fill slit 130 can be created between the top web seal on one panel (e.g., 104 or 102)—shown in the panel opposing the device 112 for this exemplary embodiment. This permits the packager to fill the package 100 easily with contents. The package formation machine can apply the top seal and the top gusset seal, and the packer or packager can fill the product through the slit 130. The slit 130 can be formed or otherwise provided across the entire front (or back) panel—102, 104. Once the package is filled with product or contents (FIG. 22), the packager or machinery simply makes a seal just under or at the fill slit 130, sealing the underside of the slit panel to the top gusset film (FIG. 23).

Referring generally to FIGS. 24-34, the safety flap 114 can be added to the flange, e.g., front flange of a zipper or like closure device having flanges attached to the inside of that package, and with the device opening into the respective panel. For instance, U.S. Pat. Nos. 4,909,017, 5,972,396, 5,461,845, 5,672,009, 5,782,733, 5,902,047, 5,954,433, and 6,177,172 are directed to some exemplary re-closeable devices, and other features and techniques for flexible packaging that can be employed with the present invention, and are therefore incorporated herein by reference in their entirety.

The safety flap 114 can be added during the application of the zipper 112 device to the web, or it could be added to the zipper from the zipper supplier. Further, a film can be perforated over the top of the zipper 112 with the tab 152 facing downward from the top of the zipper. The consumer can grab the tab 152, pull it to separate it (e.g., torn or otherwise removed) from the rest of the package (e.g., up to its hinge point), exposing the bottom edge of the safety flap 114. Next, they can lift up the safety flap 114 to expose the front top flange of the zipper 112 to open the package.

Figure 31:
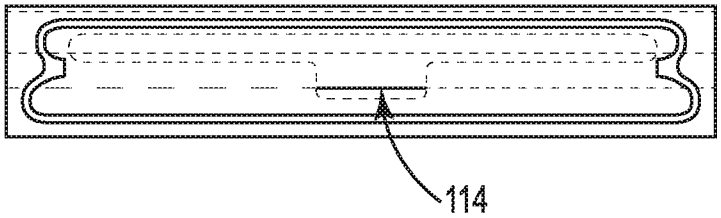
FIG. 31 shows a safety flap and zipper device having a tamper evident perforated film removed, in accordance with embodiments of the present invention.
Figure 39:
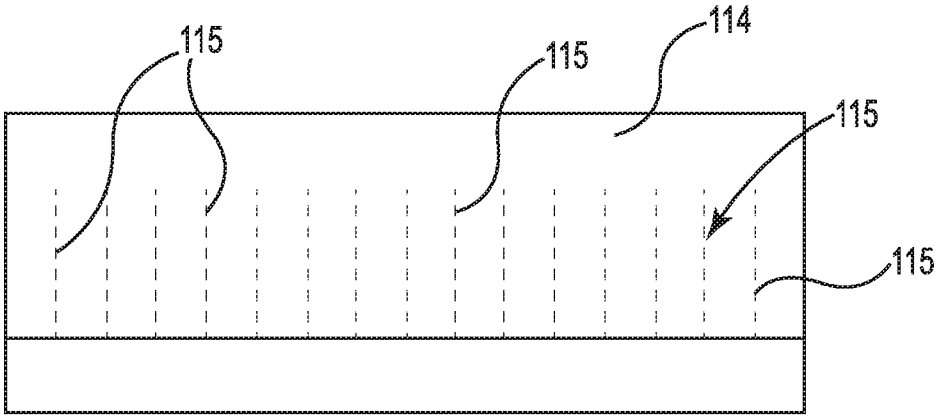
FIG. 39 shows a package portion having a front panel closure device with a safety flap having a plurality of perforations, in accordance with embodiments of the present invention.
Figure 40:
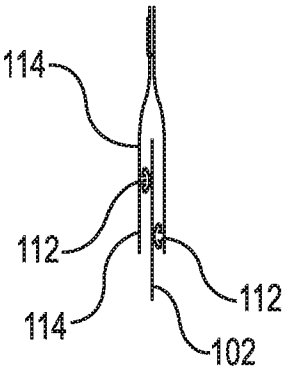
FIG. 40 is a side schematic cross-section view of the package portion of FIG. 39.
Figure 41:
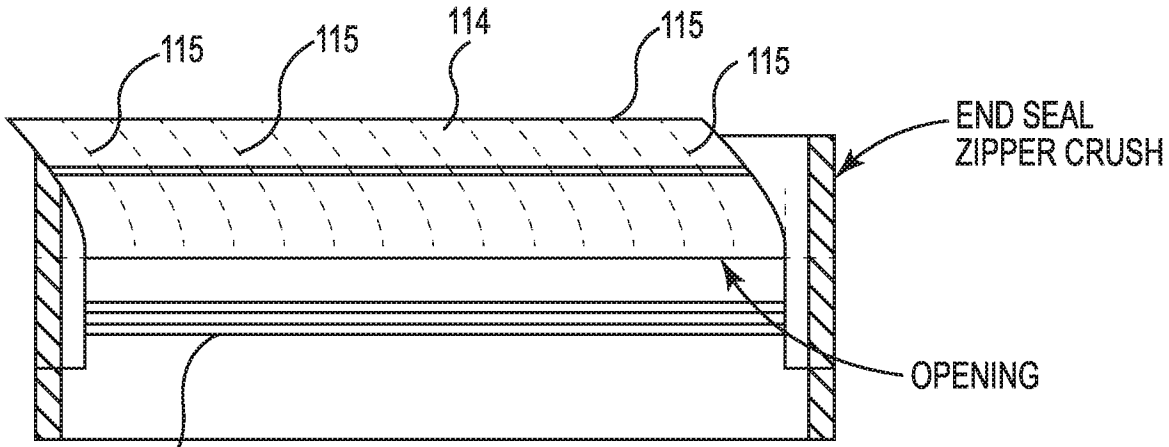
FIG. 41 shows a package portion having a front panel closure device with a perforated safety flap being lifted, in accordance with embodiments of the present invention.
Figure 42:
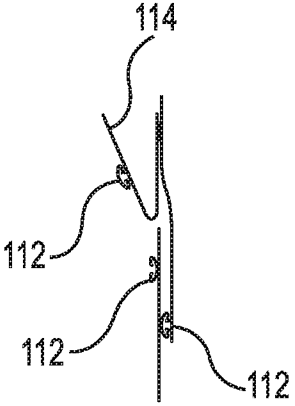
FIG. 42 is a side schematic cross-section view of the package portion of FIG. 41.
Figure 43:
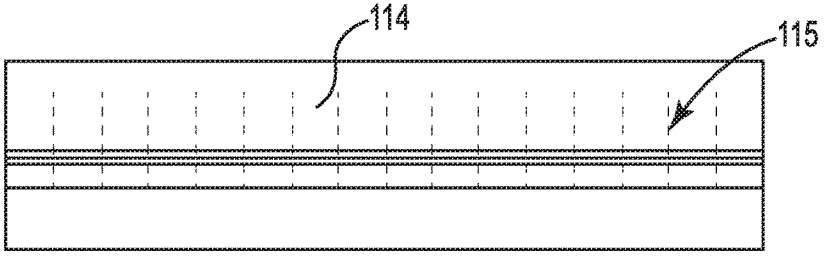
FIG. 43 shows a portion of a top opening package having a closure device with a safety flap having a plurality of perforations, in accordance with embodiments of the present invention.
Figure 44:
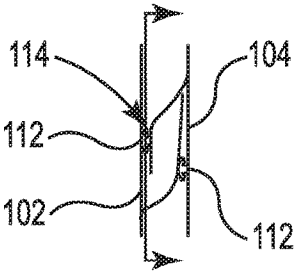
FIG. 44 is a side schematic cross-sectoin view of the package portion of FIG. 43.
Figure 45:
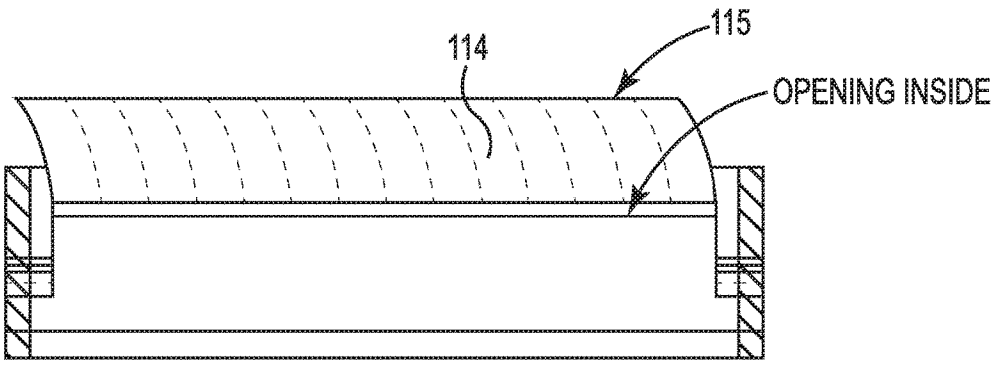
FIG. 45 shows a portion of a top opening package having a closure device with a perforated safety flap being lifted, in accordance with embodiments of the present invention.
Figure 46:
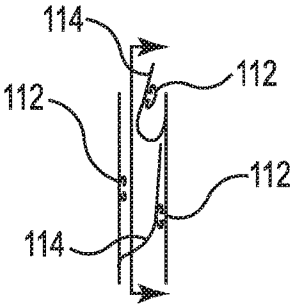
FIG. 46 is a side schematic cross-sectoin view of the package portion of FIG. 45.

In general, it should be understood that a piece of film, flap, or the like can be provided with the present invention to cover or hide the opening of a package from younger children so it is not easy for them to open. The piece of film or flap can be included with or separate from the zipper or like device of the package, and can reside at least partially inside or outside of the package. FIG. 31 shows an embodiment with the tamper evident film removed.

The tamper evident section of film does not need to be a removable piece in certain embodiments. Namely, the film could either be a slit in the film to enable the consumer to get at the safety flap, or it could be a hinged flap of film itself, that the consumer will lift up, finding the safety flap, and thereby enabling them to lift it up and expose the top opening of the zipper flange.

In addition, the safety flap 114 can be slit or perforated on each end, inside the zipper end seals, so it will more readily lift up at each end, in certain embodiments of the present invention.

As shown in FIGS. 32-38, the safety flap 114 can include one or more zipper devices 112, with the safety flap 114 provided internal or external to the main package panels to make it more difficult to access and manipulate the safety flap 114, to promote child restrictiveness. As such, the zipper 112 of the safety flap 114 must be detached (e.g., via male and/or female interlocking members as shown) from an opposing or adjacent panel of the package, and the flap 114 can then be lifted to provide access into the package. Other access devices or techniques, such as Velcro™, snaps, adhesives, buttons, clips, temporary seal bonds, tabs, and the like can be employed for one or more of the devices 112 for this and other embodiments of the present invention. FIGS. 35-38 are directed to embodiments of the safety flap attached to a a closure device 112, or the flange of a closure device, for a top opening package (in contrast to a front panel closure device such as FIGS. 32-34).

As depicted in FIGS. 39-47, as with other embodiments of the present invention, a zipper or other closure 112 can be made with this same concept, having a safety flap 114 that creates an additional step to open the package, thereby restricting children from getting into a package they should not be in. With such embodiments, the closure could be made as a separate step and later added into the package either as a pre-made pouch, or on a form fill and seal application.

In order to make the flap more user friendly, and lift up out of the way of the final opening to the package, it can be beneficial to add perpendicular or otherwise transverse perforations 115 or like features to the first opening portion, or safety flap portion of the recloseable device. Multiple perforations, approximately ¾" apart in certain embodiments, can be made on the safety flap 114 or one of the opening flanges so the closure does not necessarily need to be placed in register with the package side or end seals. On a typical stand-up pouch style package, the consumer would initially tear off the top seal of the package, which is also the case with these embodiments of the present invention. The recloseable device 112 can include a first locking member (e.g., male member), such that after the top seal is removed the consumer would need to pull it apart to open. Once the first locking member is opened, they will still not be able to gain access into the package until they lift the safety flap 114. The interlocking member or device can be located on either side of the safety flap. Since the safety flap 114 is made as part of the closure device 112, the ends of the flaps 114 can be sealed into the side seals of the package and thus would not easily lift up. The consumer can lift the flap 114 upward, and peal or tear the perforations 115 on the flap 114 near the ends of the zipper 112. Once the perforations 115 are pealed or separated, the flap 114 will lift up out of the way completely and expose the final opening to the package that is hidden under the hinge of the first flap. The consumer can then open the second closure section and gain access into the package.

Figure 47:
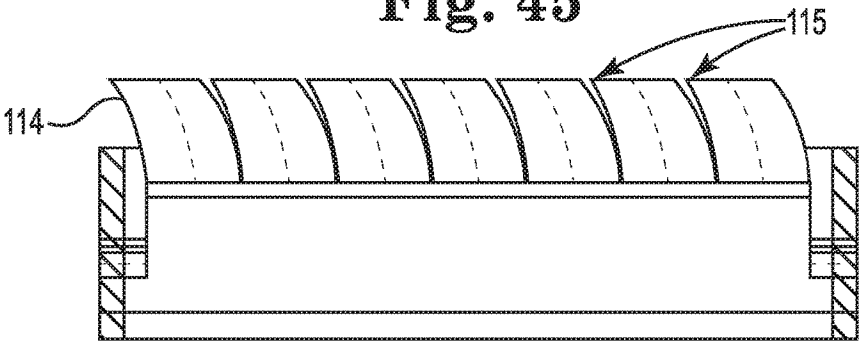
FIG. 47 shows a plurality of the perforations of FIG. 45 being separated to define a plurality of separate safety flap portions, in accordance with embodiments of the present invention.

Additionally, if the consumer has young children in the household and would like to make the package even more difficult to access the contents, more of the perforations 115 could be torn open by the adult which would create multiple safety flaps 114 that would all need to be unlocked and lifted up out of the way to reveal the final access point of the device 112 hidden under them (FIG. 47).

Figure 48:
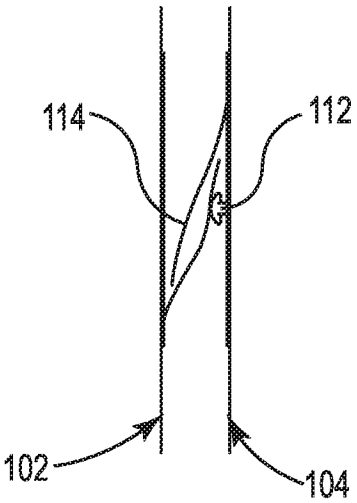
FIGS. 48-49 show a package portion having a safety flap provided in addition to one or more closure devices, in accordance with embodiments of the present invention.
Figure 49:
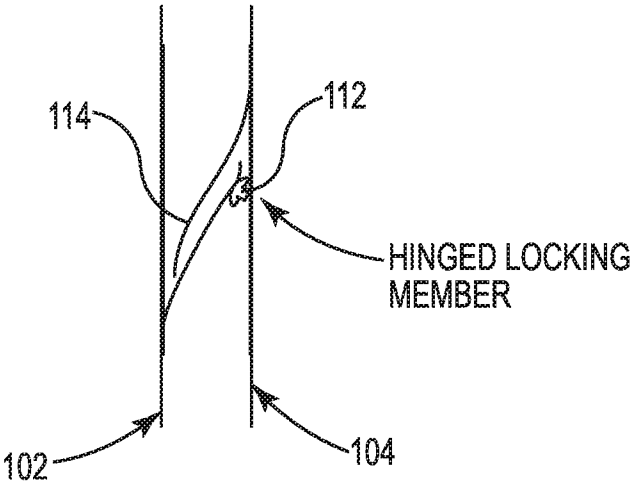

Referring to FIGS. 48-49, certain embodiments can include a zipper profile that can be applied or run on a pre-made pouch machine or a form fill and seal machine to make a child restrictive/resistant package 100. As with the other zipper embodiments, the safety flap 114 can be included as part of the zipper 112. The locking member can be hinged so when a user attempts to pull the package open by pulling the front 102 and back panel 104 apart, without first lifting the safety flap 114 and then opening the zipper from the top as a normal package is opened, the hinge permits the zipper 112 to turn parallel to the pulling direction, or toward the pulling direction and away from the attached panel, so that it is not easily opened (FIG. 49).

The package according to the invention can including packages constructed, in whole or in part, of flexible, rigid, semi-rigid, or semi-flexible materials or panels. Briefly, the package panel portions are generally constructed of flexible sheet material such as polyethylene, polyester, metal foil, polypropylene, or polyethylenes or polypropylenes laminated with other materials such as nylon, polyester, tear resistant, and like films. To provide for increased barrier properties, embodiments can use composite or laminate layers of said materials and material of the like. Generally, in such composite or laminate embodiments, a material having preferred sealing characteristics can be joined, bonded or laminated to a material having a different preferred characteristic (e.g., beneficial oxygen barrier properties). Regardless, single sheets, composites/laminates, and a myriad of other materials and techniques known to one skilled in the art may be implemented based on particular usage and manufacturing needs without deviating from the spirit and scope of the present invention. The present invention in certain embodiments permits the flexible package to be made using less expensive or cheaper materials than would otherwise be necessary.

The package 100 and its portions can be formed to provide a stand-up pouch, pre-made pouch, bag-top, one formed and filled on a "form-fill-seal" (e.g., vertical, horizontal, etc.) machine, thermoforming machine, and other known package designs and configurations. Other known package designs and packaging techniques and features can be adapted to incorporate or form the configuration of the present invention as well.

Embodiments employing seals can utilize heat seals, adhesive bonding, and various other known sealing techniques. Further, various tearable or removable portions of seals or package portions can include notches, scoring, perforations or the like to facilitate removal.

Various figures and descriptions disclose features and accessories. However, it must be noted that these features are merely illustrative in nature and may be placed in varying locations and under varying configurations and shapes, and still be consistent with the present invention. Various regions of the package can include a handle portion, access devices (e.g., re-closeable zipper devices), and the like. In addition, the shape and configuration for the panel portions are also merely illustrative and can be altered without deviating from the spirit and scope of the present invention. Any of the panel portions, or selected regions thereof, can include various aesthetic and functional graphics, such as logos, instructions, advertising, bar codes, and the like. These graphics can run transverse, parallel, or even in a diagonal orientation to the longitudinal panel edges discussed herein.

The present invention may be embodied in other specific forms without departing from the spirit or essential attributes thereof, and it is, therefore, desired that the present embodiment be considered in all respects as illustrative and not restrictive. Similarly, the above-described methods and techniques for forming the present invention are illustrative processes and are not intended to limit the methods of manufacturing/forming the present invention to those specifically defined herein. A myriad of various unspecified steps and procedures can be performed to create or form the inventive package 100.

What is claimed is:

1. A package resistant to opening, comprising:

a first panel portion;

a second panel portion, such that at least the first panel portion and the second panel portion define the package having a content access opening, defined through the first panel portion, and an inner cavity adapted to contain package contents;

an access device having one or more locking members, provided at the content access opening, and having first and second edge flanges, the first edge flange heat sealed to the first panel portion on a first side above the content access opening and the second edge flange heat sealed to the first panel portion on a second side below the content access opening;

a tab portion defined at an exterior surface of the first panel portion and covering the content access opening in an initial packaged state; and at least one safety flap constructed of a flexible film material and having a first seal edge and a second free edge, the at least one safety flap provided at the content access opening, with the first seal edge heat sealed directly to the first edge flange of the access device above the access content opening, such that the safety flap extends across the content access opening within the inner cavity, the second free edge provided between the access device and the first panel portion within the inner cavity below the content access opening and not sealed to the access device or the first panel portion, to restrict access to the access device until a portion of the at least one safety flap is hingeably displaced such that the second free edge is lifted to expose the access device, and wherein the at least one safety flap includes a second closure feature selectively attachable to the one or more locking members of the access device.

2. The package of claim 1, wherein the access device is a recloseable zipper device.

3. The package of claim 1, further including a second safety flap.

4. The package of claim 1, wherein the tab portion includes one or more perforations to facilitate access to the content access opening.

5. The package of claim 1, wherein the second closure feature includes one or more secondary locking members.

6. The package of claim 1, wherein the first panel portion or the second panel portion includes a fill slit.

7. The package of claim 1, further including a gusseted bottom panel portion.

8. A package resistant to opening, comprising:

a first panel portion having a first interior surface and a first exterior surface;

a second panel portion having a second interior surface, such that at least the first panel portion and the second panel portion define the package having a content access opening and an inner cavity adapted to contain package contents;

an access device having first and second flanges and one or more locking members, with the first and second flanges heat sealed to the first interior surface of the first panel portion;

a tab portion provided at the first exterior surface of the first panel portion and covering the content access opening in an initial packaged state; and at least one flexible film safety flap having a first seal edge and an opposing second free edge, the first seal edge heat sealed directly to the first flange of the access device, between the first interior surface of the first panel portion and the first flange on a first side of the content access opening, with the at least one safety flap extending across the content access opening within the inner cavity such that the second free edge is provided on a second side of the content access opening, intermediate the first panel portion and the access device, not sealed to the first panel portion or the access device, and hingeable to selectively permit access to the content access opening such that the second free edge is movable away from the one or more locking members, and wherein the at least one flexible film safety flap includes a second closure feature selectively attachable to the one or more locking members of the access device.

9. The package of claim 8, wherein the access device is a recloseable zipper device.

10. The package of claim 8, wherein the tab portion includes one or more perforations to facilitate access to the content access opening.

11. The package of claim 8, wherein the second closure feature includes one or more secondary locking members.

12. The package of claim 8, further including a second safety flap.

13. The package of claim 8, wherein the first panel portion or the second panel portion includes a fill slit.

14. The package of claim 8, further including a gusseted bottom panel portion.

15. A resistant package opening system, comprising:

a recloseable access device having a device opening portion, at least first and second flanges, and one or more mating elements, with the first and second flanges heat sealed to an interior surface of a first package panel portion;

a perforated tab portion provided with an outside surface of the first package panel portion and covering the device opening portion in an initial packaged state; and at least one flexible film safety flap having a first seal edge and an unsealed second free edge, the first seal edge directly heat sealed to the first flange of the recloseable access device on a first side of the device opening portion, the at least one safety flap draping across the device opening portion within an interior package area, such that the unsealed second free edge is positioned below a second side of the device opening portion within the interior package area, to inhibit access to the recloseable access device until the second free edge of the at least one safety flap is hingeably displaced away from the recloseable access device, with the at least one flexible film safety flap including a second closure feature selectively attachable to the one or more mating elements of the recloseable access device.

16. The system of claim 15, further including a second safety flap.

17. The system of claim 15, wherein the second closure feature includes a zipper closure feature.

18. The system of claim 15, wherein the second closure feature includes one or more secondary locking members.

19. The system of claim 15, wherein the recloseable access device is a recloseable zipper device.

* * * * *